United States Patent [19]

Marschke et al.

[11] Patent Number: 4,776,577

[45] Date of Patent: Oct. 11, 1988

[54] SHINGLING OF DELICATE CONVEYED SHEET MATERIAL

[75] Inventors: Carl R. Marschke; Richard H. Thomas; Dennis W. Rodewald, all of Phillips, Wis.

[73] Assignee: Marquip, Inc., Phillips, Wis.

[21] Appl. No.: 24,344

[22] Filed: Mar. 10, 1987

[51] Int. Cl.[4] ..... B65H 29/68

[52] U.S. Cl. ..... 271/183; 271/151; 271/197

[58] Field of Search ..... 271/183, 231, 202, 203, 271/270, 150, 151, 197

[56] References Cited

U.S. PATENT DOCUMENTS

| | | | |
|---|---|---|---|
| 2,743,923 | 5/1956 | Watter . | |
| 2,919,789 | 1/1960 | Coakley | 271/183 X |
| 3,232,605 | 2/1966 | Plummer | 271/183 |
| 3,275,317 | 9/1966 | Fromm, Jr. . | |
| 3,314,676 | 4/1967 | Fromm, Jr. . | |
| 3,351,196 | 11/1967 | Van Laanen . | |
| 3,391,926 | 7/1968 | Jaatinen . | |
| 3,482,833 | 12/1969 | Schleiden . | |
| 3,599,969 | 8/1971 | West . | |
| 3,659,839 | 5/1972 | Baucke | 271/183 |
| 3,717,249 | 2/1973 | Faley . | |
| 3,724,687 | 4/1973 | Marschke et al. . | |
| 3,730,517 | 5/1973 | Norton | 271/183 |
| 4,200,276 | 4/1980 | Marschke . | |
| 4,273,324 | 6/1981 | Phillipp | 271/183 |
| 4,314,868 | 2/1982 | Hirakawa . | |
| 4,598,901 | 7/1986 | Thomas . | |

*Primary Examiner*—Richard A. Schacher

*Attorney, Agent, or Firm*—Andrus, Sceales, Starke & Sawall

[57] ABSTRACT

A vacuum shingler for a plurality of sheets (9) traveling in succession through an upstream infeed nip (13) is provided with a vacuum modulating control which applies sheet slow-down forces primarily to only the tail ends of the sheets. In one embodiment, the control provides a substantially "on-off" vacuum operation, with the vacuum "off" when the leading end portion of the sheet is adjacent the vacuum plenum opening(s) (39), and with the vacuum "on" when the tail end portion of the sheet is adjacent the opening(s). In another embodiment, the control modulates the vacuum so that it is at a basically unshingling low or reduced level when the leading end portion of the sheet is adjacent the opening(s), and is at a substantially increased high level when the tail end portion of the sheet is adjacent the opening(s) so that basic shingling occurs. The vacuum modulating control includes devices (12, 63) for sensing the position, speed and length of the traveling sheets, with this information being processed to provide an output signal which controls the speed of a shaft (52) with which a rotary valve is associated. The valve is disposed within the vacuum shingler plenum (34) and modulates the flow of air through the plenum opening(s) in correlation with the determined information. The vacuum shingler assembly is disposed so that its sheet input is substantially horizontally aligned with the discharge of the infeed nip (13). Furthermore, the assembly is disposed with its conveyor portions (28) generally horizontal, rather than inclined, so that even the middle of a sheet is supported thereby as the sheet spans the conveyor.

4 Claims, 3 Drawing Sheets

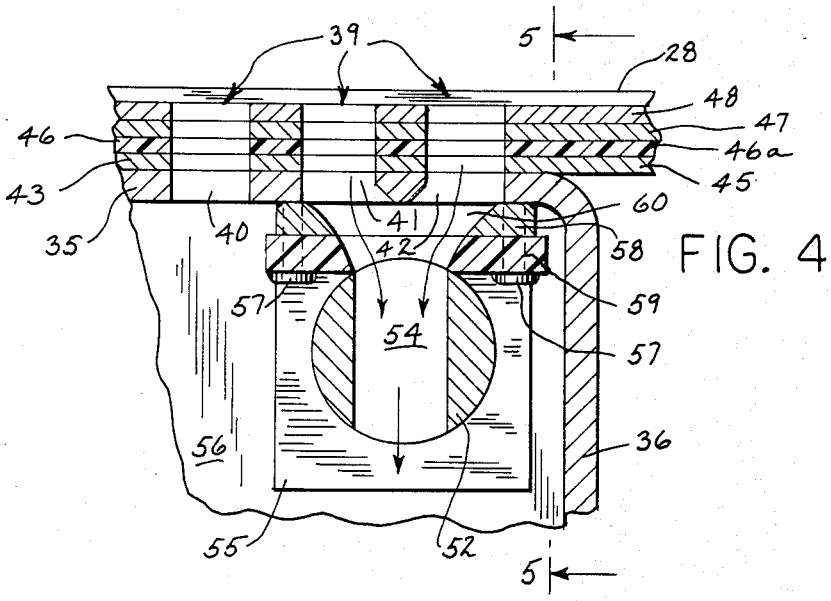
FIG. 4
FIG. 5
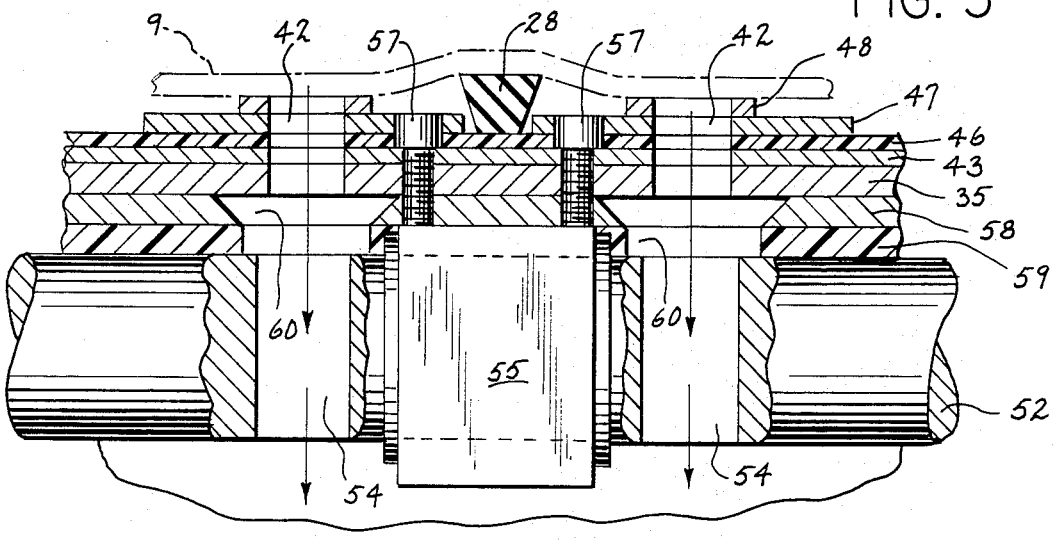
FIG. 6
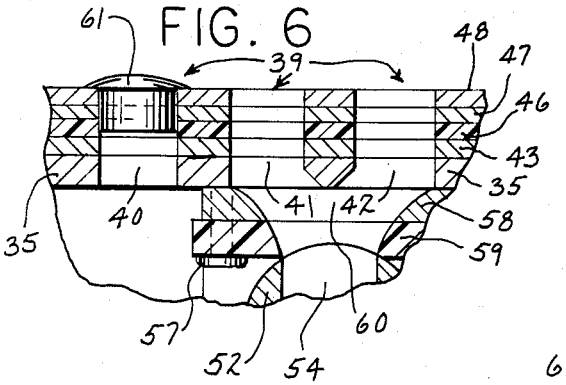
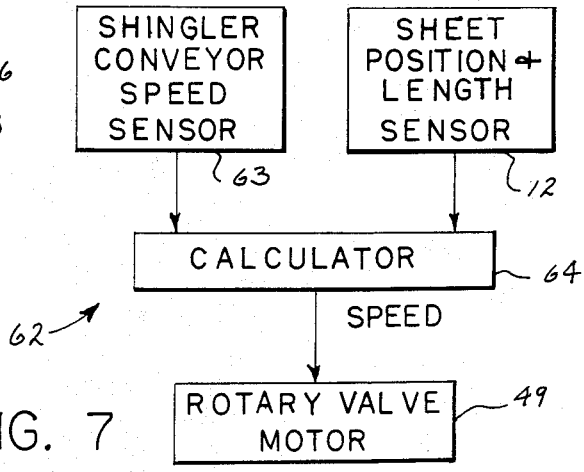
FIG. 7

SHINGLING OF DELICATE CONVEYED SHEET MATERIAL

BACKGROUND AND SUMMARY OF THE INVENTION

This invention relates to shingling of delicate conveyed sheet material, and more particularly to shingling of sheets of delicate corrugated paperboard or the like which are being conveyed at relatively high speeds. The invention may be applied to downstacking devices such as those disclosed in Marschke U.S. Pat. No. 4,200,276 and Thomas U.S. Pat. No. 4,598,901.

In U.S. Pat. No. 4,200,276, a continuous web of corrugated paperboard or the like is formed in an upstream processing device and is conveyed downstream where it is cut into sheets which are fed in line through an infeed nip to a vacuum conveyor section where the sheets are shingled. The shingled sheets are then fed through several downstream conveyor sections to a sheet stacker. U.S. Pat. No. 4,598,901 discloses a generally similar device, except that it includes two vacuum conveyor sections, one which pre-shingles the sheets and the other which re-shingles the pre-shingled sheets. The patents disclose numerous controls for variable speed motors and other apparatus.

The vacuum conveyor sections disclosed in the aforesaid patents include spaced upstream and downstream shafts, one of which is driven, with belts trained around the shafts and forming conveying means for the sheets. A vacuum box or plenum is disposed between the shafts and between the upper and lower belt flights. The plenum is connected to a source of negative pressure and is provided with opening means in its upper wall to apply a vacuum to sheets being conveyed through the vacuum conveyor section. Although the opening means is disclosed in the said patents as being disposed at the downstream end of the plenum, the opening means may often be positioned at the upstream plenum end in such devices, which are generally wellknown.

Heretofore, and in machines such as those disclosed in the aforementioned patents which feed sheets generally horizontally in succession through an infeed nip and hence downstream through a vacuum shingling section, the vacuum shingler has been disposed with its upstream end at a level below the nip discharge, thus providing a drop for the traveling sheets between the infeed nip output and the vacuum shingler input. The shingler has previously been inclined upwardly in a downstream direction to facilitate proper shingling of the sheets as they skimmed across the shingler and were ultimately slowed by the continuously applied vacuum.

The operation of such known shinglers has been generally satisfactory at moderate sheet speeds, such as 500–650 ft./min. However, faster sheet speeds such as 1000 ft./min. have become increasingly desirable. One problem occurring with faster speeds, that of scattering of the shingles, has been addressed and basically solved by the dual-shingler system of the aforesaid U.S. Pat. No. 4,598,901. However, another problem has been observed as sheet spreads have increased.

As the sheets have traversed the vacuum shingler, they have had a tendency to fold transversely or buckle across their width. This so-called "beam breaking" has not only damaged the sheets but has also caused jam ups in the machine at the vacuum conveyor section, sometimes resulting in undesirable down time to clear the jam.

The cause of the buckling problem is believed to have been determined by the present inventors. It is believed that the sheets entering the vacuum shingler are not as strong or rigid as the shingler was designed to handle. When the paperboard is formed in the upstream processing device, it is in a damp or wet state. Previously, and at slow operational speeds, the web feed continuously from the upstream processing device has time to substantially fully dry before being cut into sheets and shingled. The shingler can handle the dry sheets, which have low moisture content and structural integrity. However, with increased machine speeds, the paperboard doesn't fully reach the dry state before entering the shingler, and may even be soggy at that point. Thus, as it drops downwardly from the infeed nip output onto the inclined conveyor, it tends to "beam break" or crease transversely. Furthermore, as the forward portion of the damp sheet is pulled down by the vacuum of the inclined shingler, the sheet is subjected to further buckling forces.

It is an object of the invention to solve the problem of buckling of delicate sheets at the vacuum shingler, whether the sheets are weakened due to undesirably high moisture content, or possibly of a gauge and/or material which is normally weak.

In accordance with the various aspects of the invention, the vacuum shingler for a plurality of sheets traveling in succession through an upstream infeed nip is provided with a vacuum modulating control which applies sheet slow-down forces primarily to only the tail ends of the sheets. In one embodiment, the control provides a substantially "on-off" vacuum operation, with the vacuum "off" when the leading end portion of the sheet is adjacent the vacuum plenum opening means, and with the vacuum "on" when the tail end portion of the sheet is adjacent the opening means. In another embodiment, the control modulates the vacuum so that it is at a basically unshingling low or reduced level when the leading end portion of the sheet is adjacent the opening means, and is at a substantially increased working high level when the tail end portion of the sheet is adjacent the opening means so that basic shingling occurs.

In the present embodiment, the vacuum modulating control includes further control devices for sensing the conveyor speed as well as the position and length of the traveling sheets, with this information being processed to provide an output signal which controls the speed of a shaft with which a rotary valve is associated. The valve is disposed within the vacuum shingler plenum and modulates the flow of air through the plenum opening means in correlation with the determined information.

In addition, the vacuum shingler assembly is disposed so that its sheet input is substantially horizontally aligned with the discharge of the infeed nip. Furthermore, the assembly is disposed with its conveyor portions generally horizontal, rather than inclined, so that even the middle of a sheet is supported thereby as the sheet spans the conveyor.

BRIEF DESCRIPTION OF THE DRAWINGS

The accompanying drawings illustrate the best mode presently contemplated by the inventors for carrying out the invention.

In the drawings:

FIG. 4 is an enlarged transverse horizontal section of the valve taken on line 4—4 of FIG. 2;

FIG. 5 is a vertical section taken on line 5—5 of FIG. 4;

FIG. 6 is a fragmentary view of a portion of FIG. 4, showing another embodiment of vacuum modulation; and FIG. 7 is a diagrammatic view of the modulating control circuit.

DESCRIPTION OF THE PREFERRED EMBODIMENTS

Figure 1A:
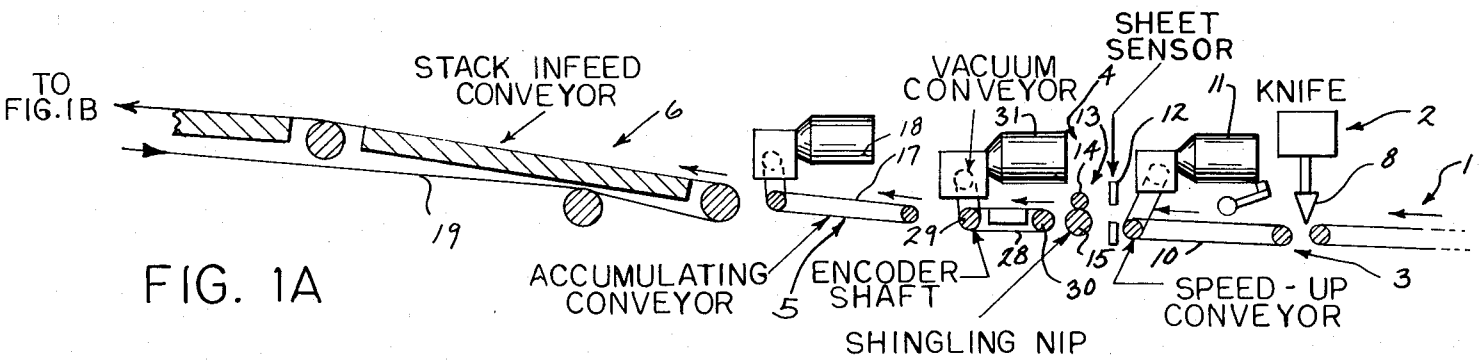
FIGS. 1A and 1B are schematic in-line views of a device adapted to incorporate the various aspects of the invention.
Figure 1B:
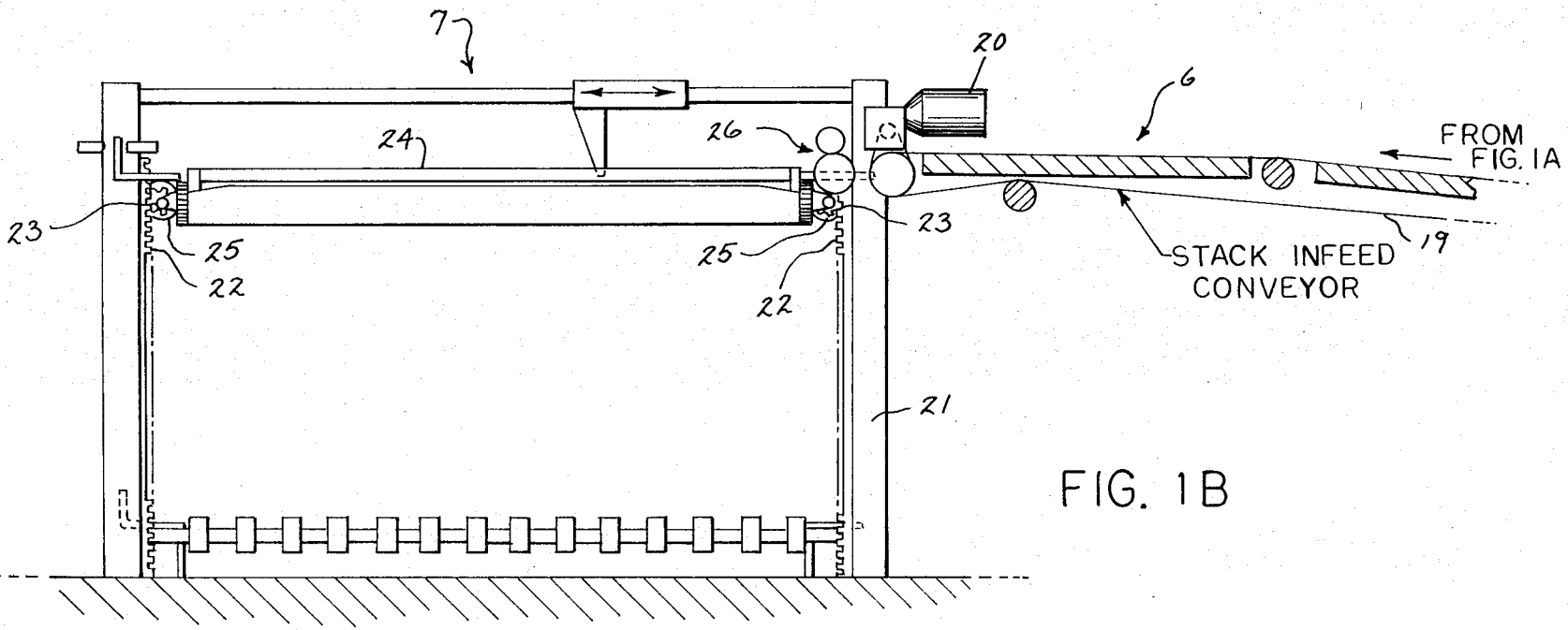

As best shown in FIGS. 1A and 1B, the concepts of the invention may be embodied in a device which includes, in line, an input conveyor section 1, a paperboard cutting section 2, a speed-up conveyor section 3, a vacuum shingling conveyor section 4, an accumulating conveyor section 5, a stack infeed conveyor section 6 and a sheet stacker 7.

Input conveyor section 1 feeds a continuous web of traveling material from a paperboard processing device (not shown) and past cutting section 2 which includes a knife 8 for severing material into separate individual sheets 9. Knife 8 may be controlled in any suitable well known way which is correlated with the input speed to provide a given number of cuts of a given length per unit of time.

Speed-up conveyor section 3 includes an endless belt 10 which is suitably driven by a motor 11 and which receives sheets from knife 8 for further transfer downstream. Section 3 is adapted to separatingly pull the traveling sheets apart and provide space therebetween, as more fully described in the aforementioned patents. A sheet position and length sensor 12, such as a photoelectric device, is disposed at the discharge end of speed-up section 3.

A shingler infeed nip 13 is disposed downstream of conveyor section 3 and comprises upper and lower nip rollers 14, 15 respectively for receipt of and feeding of sheets 9 generally horizontally therethrough.

Vacuum conveyor section 4 receives sheets from nip 13 for shingling and subsequent transfer downstream, and will be described in greater detail hereinafter.

After shingling, the sheets pass onwardly to accumulating conveyor section 5 which includes an endless belt 17 which is suitably driven by a motor 18. The sheets then pass onwardly to stack infeed conveyor section 6 which also comprises an endless belt 19 suitably driven by a motor 20. The sheets then pass on to stacker 7 which includes a pair of vertical frame members 21 having racks 22 thereon. Racks 22 in turn mesh with pinions 23 mounted on a roller-type stacker platform 24 and which are adapted to be driven by individually connected motors 25 to move the platform vertically within the frame. A nip 26 is disposed at the entrance to stacker 7 and through which the shingled sheets pass.

The device described up to this point is conventional and generally similar in construction and operation as in the aforementioned patents.

Figure 2:
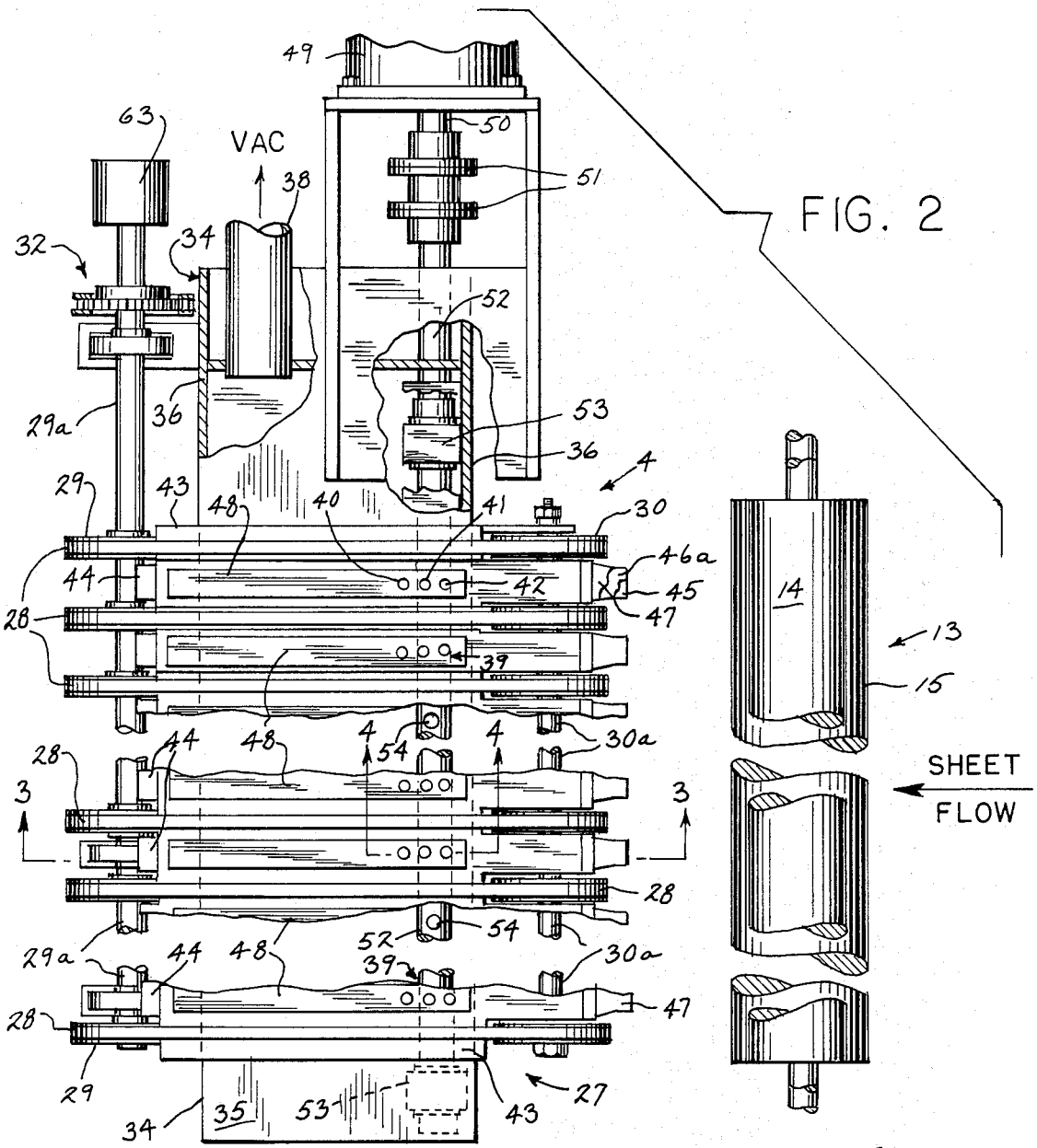
FIG. 2 is an enlarged fragmentary plan view, with parts broken away and in section, of the infeed nip and vacuum shingling section.

Turning now to vacuum shingling conveyor section 4, this section includes a vacuum shingler 27 which includes a plurality of side-by-side endless transport belts 28 which are trained about downstream front and upstream rear rollers 28, 30 respectively, mounted on respective shafts **29*a* and 30*a*; and with a motor 31 adapted to drive the belts through a chain-and-sprocket drive 32 connected to front shaft 29*a*. See FIGS. 2 and 3. Springs 33 may be suitably positioned above shingler 27 to bias sheets 9 passing thereover. An elongated vacuum box or plenum 34 is disposed between the upper and lower flights of belts 28, with plenum 34 having an upper wall 35, side walls 36 and bottom wall 37. Plenum 34 is connected via a passage 38 to any suitable source of vacuum or negative pressure, not shown. Furthermore, a plurality of sets 39 of openings 40, 41 and 42 are spaced along the upstream portion of plenum upper wall 35 and positioned between belts 28** to apply vacuum to the traveling sheets, as will be described.

Motor 31 is adapted to be driven at a substantially slower speed than motor 11 so that belts 28 will travel slower than belt 10. This slower speed, together with the vacuum, decelerates the oncoming sheets for shingling purposes.

In the present embodiment, plenum 34 is provided with a series of generally planar laminated members along its top portion. See especially FIGS. 4–6. As shown, a flat metal plate 43 is fixedly mounted on top wall 35, as by welding. Plate 43 is provided with front tongues 44 which extend downstream of plenum 34 and terminate generally above downstream shaft **29*a*. Plate 43 is also provided with rear tongues 45 which extend upstream of plenum 34 and terminate substantially upstream of upstream shaft 30*a*. A polyethylene sheet 46, with fingers 46*a*, is affixed to plate 43 and to tongue 45, respectively. A series of metal strips 47 are spacedly mounted between belts 28. Finally, a series of metal fingers 48 ride on top of the assemblage. The lamination so formed provides a raised surface to support the sheets 9, with the tongues 44 and 45, and the laminations affixed thereto, providing support for the sheets 9 between rollers 30. All of these members have openings therein which register with and form continuations of openings 40–42**.

In accordance with certain aspects of the invention, and as best shown in FIG. 1A, vacuum shingler 27 is positioned so that the upstream conveyor entrance end at the upper input flights of its belts 28 is horizontally aligned (generally coplanar) with the output of shingler infeed nip 13. Little or no downward dropping of traveling sheets occurs therebetween.

Figure 3:
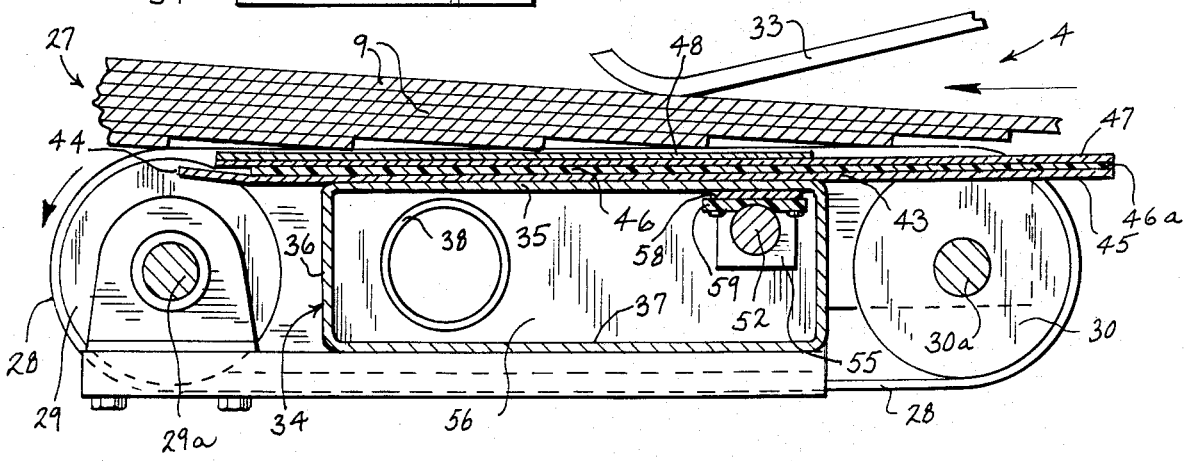
FIG. 3 is a transverse horizontal section of the vacuum shingling device, taken on line 3—3 of FIG. 2.

Furthermore, and referring especially to FIGS. 1A and 3, shingler 27 is positioned so that the top flights of conveyor belts 28, which provide a generally planar sheet supporting and transport surface, and the top of plenum 34 and its associated parts are also horizontal and generally not inclined in an upstream-to-downstream direction. Whereas the incline of these elements was previously as much as 7°, the incline of the elements of the present device is reduced to about 1° or less. The elements are also generally horizontally aligned (generally coplanar) with the output of infeed nip 13.

Turning now to additional aspects of the invention, means are provided to modulate the vacuum applied through plenum 34 so that essentially only the trailing end or tail of a traveling sheet 9 is grabbed thereby. The result is to generally prevent transverse buckling or creasing of a delicate sheet. For this purpose, the vacuum is controlled so that it is at a low non-working level, including essentially zero vacuum, when the leading end portion of a sheet passes over the sets 39 of vacuum openings; with the vacuum being increased to a substantially high working level when the trailing end portion of a sheet passes over the openings. The resultant rearward force component at the grabbed trailing end of a sheet cooperates with the forward sliding force component of the conveyor belts 28 downstream of opening sets 39 to pull the sheets flat, rather than to crumple them.

In the present embodiments, valve means are disposed within plenum 34 to modulate the vacuum flow of air passing through the sets of openings, even though negative pressure is supplied continuously from source 38. For this purpose, and referring primarily to FIGS. 2 and 4–6, a motive means such as variable speed motor 49 is suitably disposed adjacent plenum 34. Motor 49 has an output shaft 50 which is connected through a suitable coupling 51 to an elongated valve shaft 52 which extends through the interior of plenum 34 and is mounted on suitable end bearings 53. Valve shaft 52 is disposed generally beneath and parallel to plenum opening sets 39 and is provided with a plurality of holes or passages 54 extending therethrough. Passages 54 are shown as being positioned transversely along shaft 52 and in line beneath plenum openings sets 39.

As best seen in FIGS. 3–5, a valve bearing 55 is disposed beneath each set of plenum openings 41 and 42 within the plenum chamber 56, and mounted to plenum upper wall 35 as by bolts 57. A mounting plate 58 and seal 59 are disposed between wall 35 and valve bearing 55. Plate 58 and seal 59 are provided with coextensive passages 60 which are adapted to register with shaft passage 54 when the valve is open, as in FIG. 4, to provide vacuum communication between plenum chamber 56 and plenum openings 41, 42 and the exterior of the plenum beneath a traveling sheet. When the position of valve shaft 52 is rotated by motor 49 from the FIG. 4 position, passage 54 is out of communication with passages 60, thus basically blocking vacuum flow of air through openings 41 and 42. Rotation of shaft 52 alternately opens and closes the valve sequentially.

The vacuum modulation can take several forms. In the embodiment shown in FIG. 4, a small amount of vacuum may be applied continuously to a traveling sheet, even when valve shaft 52 is rotated out of the shown position to a position where openings 41 and 42 are blocked. This vacuum is applied through the third opening 40, which acts as a bypass port means and is not affected by the valve, and may be desirable under certain circumstances. A multiplicity of bypass openings may be provided if desired. The grabbing effect on a sheet, however, is minimal. When the valve is opened, as shown, vacuum is applied to a sheet through all openings 40–42, the vacuum now being substantially increased to the working point where the sheet can be fully grabbed.

In many instances, it is desirable to have a complete "on-off" vacuum modulation. This can be accomplished by eliminating plenum opening 40 altogether, so that air flow through the existing set 39 of openings 41, 42 is entirely valved. Alternately, and as shown in FIG. 6, the additional bypass opening 40 may be selectively blocked by a removable closure plug 61.

The aspects of the invention contemplate the utilizaton of a control for the vacuum modulating valve so that the sheet grabbing forces are essentially applied only to the trailing end portions of the traveling sheets, thus basically eliminating the problem of transverse "beam breaking". For this purpose, and as shown in FIG. 7, a control circuit 62 is provided. Circuit 62 includes a shingling conveyor speed sensing device which in this embodiment comprises an encoder 63 which is mounted to downstream shingler shaft 29*a*. See FIG. 2. The circuit also includes sheet position and length sensor 12. The distance between sensor 12 and the center axis of valve shaft 52 is a known fixed quantity. Furthermore, sensor 12 can be easily constructed to sense the leading and trailing edges of an individual sheet.

The outputs of shingling conveyor speed sensing device 63 and sheet position and length sensor 12 are fed to a programmable calculating device 64 of any well-known type which suitably correlates the information received and feeds it to variable speed shingler valve motor 49. It should be noted that the correlated information can indicate what rotary position valve shaft 52 should be in at any given time.

Motor 49 is responsive to the controls to provide a desired speed of rotation of valve shaft 52 so that the vacuum will be basically "off" for the forward sheet portion and "on" for the sheet tail portion as correlated with the conveyor speed as well as sheet position and length. The functioning of the various elements of the shingler is thus synchronized.

As a sheet 9 passes over shingler 27, which is horizontally aligned as previously described, the sheet is fully supported not only at its ends, but also at its midsection, thus reducing the chance of buckling.

Various types of well-known sensing devices, counters, calculators and motor actuators, and the interconnections therefor, can be utilized without departing from the spirit of the invention which provided improved concepts for shingling of sheet material.

Various modes of carrying out the invention are contemplated as being within the scope of the following claims particularly pointing out and distinctly claiming the subject matter which is regarded as to the invention.

We claim:

1. In a device for shingling individual sheets conveyed in succession upstream-to-downstream and with said sheets having downstream forward end portions and upstream trailing end portions, the combination comprising:

(a) a shingler plenum (34) having walls (35-37) forming a plenum chamber (56), (b) means (38) connecting said plenum to a source of vacuum, (c) opening means (39) disposed in a wall of said plenum for passage of vacuum air therethrough into said chamber, (d) a shingler conveyor (28) disposed adjacent said plenum and said opening means for carrying the traveling sheets thereacross for shingling the latter under the grabbing force of said vacuum, (e) and means (52) for alternately modulating the application of said vacuum through said opening means to said traveling sheets so that the forward end sheet portions are essentially free of sheet grabbing vacuum forces and so that the trailing end sheet portions are subject to working sheet grabbing vacuum forces, (f) the construction being such that delicate sheets are substantially prevented from buckling transversely as said sheets are shingled, (g) said vacuum modulating means including means for controlling the application of vacuum forces between a first vacuum level when said forward end sheet portions are passing across said opening means and a second vacuum level when said trailing end sheet portions are passing across said opening means, and with said second level being higher than said first level, (h) said opening means (39) including a plurality of openings (40–42), (i) and at least one of said openings (40) providing a vacuum air flow bypass means which is essentially unaffected by said vacuum modulating means.

2. The combination of claim 1 in which said bypass means is pluggable.

3. In a device for shingling individual sheets conveyed in succession upstream-to-downstream and with said sheets having downstream forward end portions and upstream trailing end portions, the combination comprising:

(a) a shingler plenum (34) having walls (35–37) forming a plenum chamber (56), (b) means (38) connecting said plenum to a source of vacuum, (c) opening means (39) disposed in a wall of said plenum for passage of air therethrough into said chamber, (d) a shingler conveyor (28) disposed adjacent said plenum and said opening means for carrying the traveling sheets thereacross for shingling the latter under the grabbing force of said vacuum, (e) and means (52) for alternately modulating the application of said vacuum through said opening means to said traveling sheets so that the forward end sheet portions are essentially free of sheet grabbing vacuum forces and so that the trailing end sheet portions are subject to working sheet grabbing vacuum forces, (f) the construction being such that delicate sheets are substantially prevented from buckling transversely as said sheets are shingled, (g) said vacuum modulating means including means for controlling the application of vacuum forces between a first vacuum level when said forward end sheet portions are passing across said opening means and a second vacuum level when said trailing end sheet portions are passing across said opening means, and with said second level being higher than said first level, (h) said modulating means comprising valve means (52, 54, 58–60) disposed within said shingler plenum (34) and communicating with said connecting means (38) and said opening means (39), (i) said valve mans including:

(1) a rotatable shaft (52) disposed within said plenum and disposed adjacent said opening means, (2) and passage means (54) disposed in said shaft for alternately connecting and essentially disconnecting said opening means from said plenum upon rotation of said shaft, (j) motive means (49) for moving said shaft (52) between alternate positions to sequentially change the position of said valve means to change the application of shingling vacuum forces on said traveling sheets between said first and second levels, (k) control means (12, 63, 64) for said motive means (49), said control means being responsive to the speed of said shingler conveyor (28) as well as to the position and length of the said traveling sheets to synchronize the passage of sheets over said plenum (34) with said modulating means, (l) said shingler conveyor including belt means (28) trained over upstream and downstream roller means (30, 29), (m) and said control means including means (63) connected to said downstream roller means (29) for sensing the speed of said belt means.

4. In a method of shingling individual sheets conveyed in succession upstream-to-downstream and with said sheets having downstream forward end portions and upstream trailing end portions, the steps comprising:

(a) providing:

(1) a shingler plenum (34) having walls (35–37) forming a plenum chamber (56), (2) means (38) connecting said plenum to a source of vacuum, (3) opening means (39) disposed in a wall of said plenum for passage of vacuum air therethrough into said chamber, (4) and a shingler conveyor (28) disposed adjacent said plenum and said opening means for carrying the traveling sheets thereacross for shingling the latter under the grabbing force of said vacuum, (b) alternately modulating the application of said vacuum through said openings to said traveling sheets so that the forward end sheet portions are essentially free of sheet grabbing vacuum forces and so that the trailing end sheet portions are subject to working sheet grabbing vacuum forces, so that delicate sheets are substantially prevented from buckling transversely as said sheets are shingled, (c) controlling the application of vacuum forces between a first level when said forward end sheet portions are passing across said opening means and a second level when said trailing end sheet portions are passing across said opening means, (d) and providing a vacuum force at said first level of vacuum forces which is less than said second level.

* * * * *

UNITED STATES PATENT AND TRADEMARK OFFICE

CERTIFICATE OF CORRECTION

PATENT NO. : 4,776,577

DATED : October 11, 1988

INVENTOR(S) : Carl R. Marschke et al

It is certified that error appears in the above-identified patent and that said Letters Patent is hereby corrected as shown below:

Column 1, line 63, delete "spreads" and substitute therefor -- speeds--.

Column 2, line 9, delete "feed" and substitute therefor --fed--.

Column 7, line 26, after "of" insert --vacuum--.

Signed and Sealed this

Twenty-eighth Day of February, 1989

*Attest:*

DONALD J. QUIGG

*Attesting Officer*

*Commissioner of Patents and Trademarks*